United States Patent [19]

Oatman

[11] Patent Number: 4,658,515

[45] Date of Patent: Apr. 21, 1987

[54] HEAT INSULATING INSERT FOR FOOTWEAR

[76] Inventor: Donald S. Oatman, 6122 Patrick Henry, San Antonio, Tex. 78233

[21] Appl. No.: 698,452

[22] Filed: Feb. 5, 1985

[51] Int. Cl.[4] ..... A43B 13/38

[52] U.S. Cl. ..... 36/44; 36/31; 36/35 R; 36/43

[58] Field of Search ..... 36/44, 43, 30 A, 31, 36/77 M, 77 R, 28, 35 R, 35 B, 29, 71

[56] References Cited

U.S. PATENT DOCUMENTS

| | | | |
|---|---|---|---|
| 1,210,375 | 12/1916 | Decker | 36/44 |
| 1,559,532 | 10/1925 | Smith | 36/28 |
| 1,574,872 | 3/1926 | Daly | 36/77 R |
| 2,088,707 | 8/1937 | King | 36/44 |
| 2,641,068 | 6/1953 | Thompson | 36/44 |
| 2,736,109 | 2/1956 | Scholl | 36/44 |
| 2,751,691 | 6/1956 | Clark | 36/77 R |
| 2,797,201 | 6/1957 | Veatch | 260/2.5 |
| 2,814,888 | 12/1957 | Hill | 36/77 R |
| 3,398,469 | 8/1968 | Bressan | 36/44 |
| 3,552,044 | 1/1971 | Wieli | 36/119 |
| 4,054,706 | 10/1977 | Shapiro | 36/44 |
| 4,055,699 | 10/1977 | Hsiung | 36/44 |
| 4,108,928 | 8/1978 | Swan | 36/71 |
| 4,252,910 | 2/1981 | Schaefer | 36/71 |
| 4,255,202 | 3/1981 | Swan | 36/117 |
| 4,257,176 | 3/1981 | Hartung | 36/4 R |
| 4,263,727 | 4/1981 | Bender | 36/44 |
| 4,502,234 | 3/1985 | Schaefer | 36/28 |
| 4,524,529 | 6/1985 | Schaefer | 36/44 |

FOREIGN PATENT DOCUMENTS

| | | | |
|---|---|---|---|
| 0130816 | 1/1985 | European Pat. Off. | 36/31 |
| 2522482 | 9/1983 | France | 36/31 |
| 199120 | 3/1922 | United Kingdom | 36/30 A |

*Primary Examiner*—Werner H. Schroeder
*Assistant Examiner*—Mary A. Ellis
*Attorney, Agent, or Firm*—Norvell & Associates

[57] ABSTRACT

A heat retention insole for shoes comprises a laminated structure incorporating a flexible plastic bottom sheet, a similar flexible plastic upper sheet, and a spacer sheet formed primarily of foamed organic plastic material. The spacer sheet is provided with large area apertures defined by bars extending transversely between portions of a perimetral band portion. The large area apertures are loosely filled with particles of insulating plastic material, thus assuring that the top and bottom sheets are maintained in spaced relationship even when subjected to foot pressure. The outer surfaces of the insole are preferably provided with a heat reflecting coating or film to minimize the loss of heat from the foot by radiation and reflect any such radiated heat back into the foot of the wearer.

3 Claims, 5 Drawing Figures

HEAT INSULATING INSERT FOR FOOTWEAR

BACKGROUND OF THE INVENTION

1. Field of the Invention

The invention relates to a heat insulating insert for footwear such as shoes, boots and the like.

2. Description of the Prior Art

There have heretofore been proposed a variety of heat insulating footwear to keep the human feet to which the footwear is applied warm during cold weather seasons. Additionally, cushioned insoles formed of a foamed plastic material have heretofor been available to provide comfort to the foot of the wearer, while inherently providing some degree of insulation against heat loss from the foot during cold weather. In fact, the need for foot warmth is so well recognized that numerous patents have been issued on footwear containing exothermic chemicals which react to chemically produce heat and thus maintain the desired degree of foot comfort during cold weather. All of such constructions have been deficient either in their ability to maintain a desired degree of foot warmth, or, in the case of the exothermic footwear devices, because they are expensive and require continuous replacement of the exothermic chemicals producing the heat.

SUMMARY OF THE INVENTION

The invention provides a simple economic device for the preservation of body heat in the foot in such a manner that the effect is seemingly that of heat generation. Thus, an insole is provided in the form of a laminated pad which is horizontally contoured to be snugly insertable within the shoe and thus be in intimate contact with the bottom of the foot. The laminated pad is formed from three elements, respectively a bottom sheet of flexible plastic material, a top sheet of similar flexible plastic material and a spacer sheet which is perimetrically bonded to the perimeters of the top and bottom sheets. The spacer sheet is formed from any one of a number of foamed organic plastic materials such as neoprene, polystyrene, polyethelyene, and polyurethane, to name a few. The spacer sheet is not continuous but is provided with a plurality of relative large area apertures separated by bands of the spacer sheet material extending transversely across the insole. There is thus defined a plurality of spaced pockets which are sealed around the perimeters and are then loosely filled with particles of foamed organic plastic materials similar to those used in the spacer material. The particles thus prevent a collapse of the bottom and top sheets into abutting relationship in the apertures.

At least one of the sheets may have its outermost surface coated with a heat reflecting material, such as a thin film of aluminum. Preferably the heat reflecting material is applied to both of the outwardly facing surfaces of the top and bottom sheets so that regardless of whether the insole is inserted in a right shoe or a left shoe, the heat reflecting layer will be disposed immediately adjacent the foot of the wearer. This insures that heat loss due to radiation will be immediately reflected back into the wearer's foot and the unusually high degree of insulation against loss by conductivity provided by the aforedescribed apertured spacer and particle construction further prevents the loss of body heat by conductivity. Thus, an apparent feeling of warmth is generated by the insole but, of course, the warmth is merely the result of the reduction of loss of the body heat through the bottom of the foot.

In a modification of this invention, a toe covering is provided which is formed of the same laminated construction as described for the insole. Such toe portion is then perimetrically bonded to the toe portions of the laminated insole and provides a trapping of the heat loss from the upper surfaces of the toes in the same manner as heretofore described.

Further objects and advantages of the invention will be readily apparent to those skilled in the art from the following detailed description, taken in conjunction with the annexed sheets of drawings, on which is shown the preferred embodiments of the invention.

DESCRIPTION OF THE PREFERRED EMBODIMENTS

Figure 1:
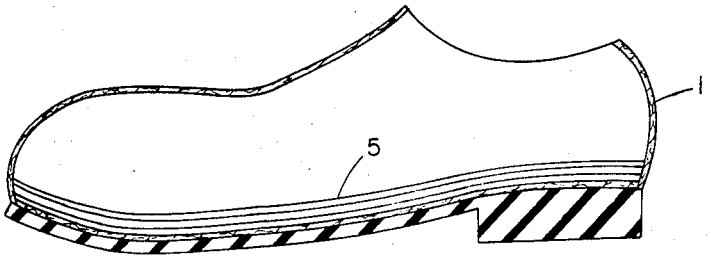
FIG. 1 is a vertical, sectional view of a conventional shoe showing an insole embodying this invention inserted therein.

Referring to FIG. 1, an insole 5 embodying this invention is horizontally contoured to fit snugly within the confines of a conventional shoe or boot 1. In such position, the upper surface of the insole is in intimate contact with the bottom of the foot of the wearer.

Figure 2:
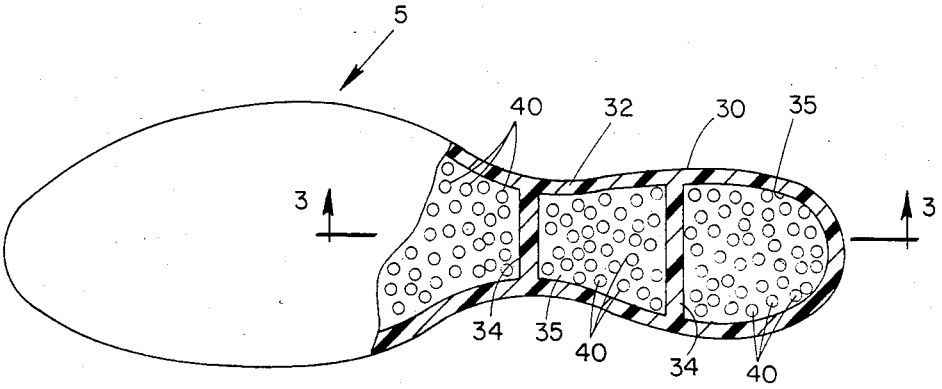
FIG. 2 is a top elevational view of an insole embodying this invention, with a portion shown in section.
Figure 3:
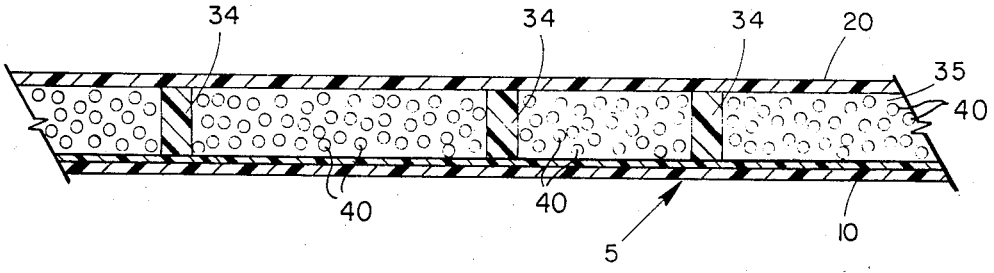
FIG. 3 is an enlarged scale sectional view taken on the plane 3—3 of FIG. 2.

Referring to FIGS. 2 and 3, the insole 5 embodying this invention will be shown as comprising a laminated pad having a bottom sheet or liner 10, an upper sheet or liner 20, and an intermediate spacer sheet 30. Both the top and bottom sheets 20 and 10 are preferably formed from a flexible organic plastic material, such as nylon, polystyrene, polyethelyene or polypropylene. The spacer sheet 30, is formed from a foamed, organic plastic material such as foamed neoprene, foamed polystyrene, foamed polyethelyene, foamed polyurethane, etc. . . . , thus providing both resiliency and heat insulation. All three sheets or layers of the laminated insole 5 are horizontally contoured to fit snugly within the confines of the shoe 1. The top and bottom sheets 10 and 20 are perimetrically bonded, either by heat fusion or a suitable adhesive, to the top and bottom surfaces of the perimeter and other portions of the intermediate spacer sheet 30.

The spacer sheet 30 is not a continuous sheet but is provided with a plurality of laterally spaced apertures of substantial area. In fact, the spacer sheet 30 may be defined as having a perimeter band portion 32 which is interconnected by a plurality of integral transverse band portions 34, thus defining a plurality of apertures 35 between the band portions 34 and the perimeter portion 32. The apertures 35 are each loosely filled with a plurality of particles 40. Thus, particles 40 may move around in apertures 35. Particles 40 are preferably formed of the same material as the spacer sheet 30 and may comprise shavings of such material. Alternatively, particles 40 may comprise hollow polystyrene or polyethelyene beads. In any event, particles 40 have resilient properties, are resistant to conduction of heat, and function primarily to maintain the top and bottom sheets 10 and 20 in vertically spaced relationship despite the application of foot pressure upon the apertured areas 35 of the spacer sheet 30.

As illustrated in FIG. 3, the material from which the spacer sheet 30 is fabricated preferably has an unfoamed, solid liner portion 36 bonded to one surface of the foamed material to protect the relatively fragile foamed material from damage during the handling and cutting operations thereon.

Figure 4:
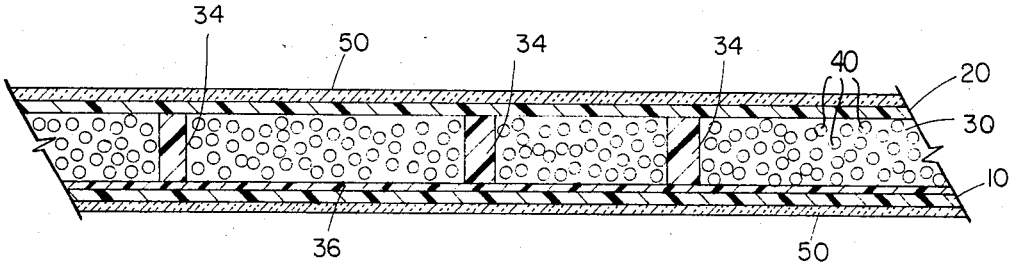
FIG. 4 is a view similar to FIG. 3, but illustrating a modification of this invention.

With this construction, the insole 5 will be found to provide a substantially higher degree of heat retention in the foot than would be obtained through the simple utilization of a continuous foamed plastic insert, such as used for foot cushioning purposes. To further increase the heat retention capabilities of the insole 5, the modification of FIG. 4 may be employed wherein a heat reflecting coating or film 50 is applied to each of the outwardly facing surfaces of the bottom and top sheets 20 and 10 respectively. Thus, the insole 5 may be inserted in either a right shoe or left shoe merely by reversing its position 180°, but in each position, a heat reflecting layer 50 will be disposed immediately adjacent to the bottom of the foot of the wearer. Such heat reflecting layer obviously functions to substantially reduce the radiation of heat from the bottom of the wearer's foot by reflecting such radiated heat directly back into the foot, thus giving the feeling of apparent warmth being provided by the insole 5.

Figure 5:
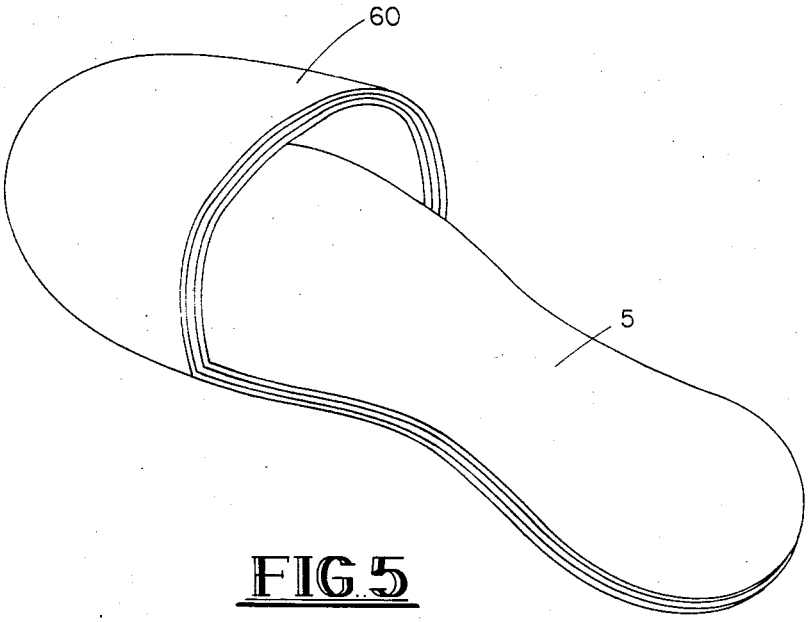
FIG. 5 is a perspective view of an insole embodying this invention incorporating a toe covering.

Still another modification of the invention is illustrated in FIG. 5 wherein a toe portion 60 is formed of a laminated construction identical to the lamination employed in the formation of the insole 5. Such toe portion 60 is perimetrically bonded to the toe portions of the insole 5 and thus provides heat insulation protection for the sides and upper portions of the toes of the wearer.

The improved thermal efficiency of an insole embodying this invention cannot be readily explained, particularly its superiority over an insole formed of a continuous sheet of foamed plastic. Foot comfort tests conducted by a number of individuals have revealed that the insole 5 embodying this invention definitely retains a substantially greater degree of body heat adjacent to the foot than conventional cushioned insole inserts. In fact, the degree of heat retention is such as to create a feeling of apparent warmth being emitted by the insole. In any event, the comfort of the wearer is substantially improved when wearing shoes equipped with the aforedescribed insole in cold weather.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by letters patent is:

1. A heat insulating insole for shoes comprising a laminated pad horizontally and vertically contoured to lie within a shoe beneath the foot of the wearer of the shoe; said laminated pad comprising a bottom sheet, a spacer sheet and a top sheet; said bottom and top sheets formed from a flexible organic plastic film and said spacer sheet being formed from a resilient, readily compressible, foamed sheet of organic plastic material having heat insulating properties; said spacer sheet being bonded to both said bottom and top sheets; said spacer sheet comprising a continuous perimeter disposed between and bonded to the perimeters of said top and bottom sheets, said spacer sheet further having a plurality of transverse bands integrally joining opposite sides of said continuous perimeter to define a plurality of horizontally spaced chambers; said chambers being vertically bounded by said top and bottom sheets and horizontally bounded by said transverse bands and said perimeter portion of said spacer sheet; said chambers being partially filled with loose particles formed from a resilient organic plastic material having heat insulating properties.

2. The insole of claim 1 wherein said spacer sheet is formed from polystyrene foam and said particles comprise shavigs of polystyrene foam.

3. The insole of claim 1 wherein said particles comprise shavings of polystyrene foam.

* * * * *